United States Patent [19]

Vider

[11] Patent Number: 4,560,349

[45] Date of Patent: Dec. 24, 1985

[54] HEAT RECUPERATOR AND METHOD FOR USE WITH GAS-FIRED FURNACE USING NOZZLE OR PRE-MIX BURNERS

[75] Inventor: Leslie Vider, Hampstead, Canada

[73] Assignee: Sivaco Quebec, Quebec, Canada

[21] Appl. No.: 650,494

[22] Filed: Sep. 14, 1984

[51] Int. Cl.[4] ..... F28F 1/10

[52] U.S. Cl. ..... 432/223; 432/180; 432/209; 432/222; 110/254

[58] Field of Search ..... 432/209, 223, 222, 179, 432/180; 110/254; 126/91 A, 91 R

[56] References Cited

U.S. PATENT DOCUMENTS

| | | | |
|---|---|---|---|
| 3,207,493 | 9/1965 | Swain | 432/180 |
| 3,566,615 | 3/1971 | Roeder, Jr. | 165/156 |
| 3,712,597 | 1/1973 | Waitkus et al. | 432/180 |
| 3,829,285 | 8/1974 | Beck | 432/223 |
| 4,060,369 | 11/1977 | Schante et al. | 126/91 A |
| 4,102,632 | 7/1978 | Hastings | 432/223 |
| 4,140,482 | 2/1979 | Simon | 432/209 |
| 4,214,869 | 7/1980 | Thekdi et al. | 432/209 |
| 4,218,211 | 8/1980 | Caplan | 432/209 |
| 4,373,903 | 2/1983 | Winning | 432/209 |
| 4,432,791 | 2/1984 | Joyaraman et al. | 432/209 |

*Primary Examiner*—Henry C. Yuen

*Attorney, Agent, or Firm*—Oblon, Fisher, Spivak, McClelland & Maier

[57] ABSTRACT

A heat recuperator and a method for recuperating heat from a furnace having a nozzle-mix burner to enhance the efficiency of combustion of one or more burners associated with the furnace. The recuperator comprises an exhaust tube which is connectable to a furnace combustion chamber for receiving heated exhaust gas therethrough. The exhaust tube has an outer cylindrical wall and an inner metallic tube concentrically supported therein. An annular space is defined between the outer cylindrical wall and the inner tube. The inner tube is formed, in at least a major length thereof, with a plurality of corrugations. An air inlet connection is provided at an inlet end of the annular space downstream of the exhaust tube. The annular space also has an outlet upstream of the exhaust tube adjacent an inlet end thereof and connectable to a burner supplying same with heated combustion air. A blower is connectable to the inlet to direct the flow of ambient air in the annular space from the inlet to the outlet of the annular chamber. The corrugated wall induces turbulence to the ambient air and also provides a large heated surface area to enhance heat exchange between the heated exhaust gas and the ambient air.

1 Claim, 3 Drawing Figures

HEAT RECUPERATOR AND METHOD FOR USE WITH GAS-FIRED FURNACE USING NOZZLE OR PRE-MIX BURNERS

BACKGROUND OF INVENTION (a) Field of the Invention

The present invention relates to an improved heat recuperator and method of recuperating heat loss from a furnace to enhance the efficiency of combustion of one or more nozzle or pre-mix burners associated with the furnace, and particularly to one or more exhaust tube recuperators each having a heat exchanger formed by an inner and outer tube concentrically secured to one another to define an annular space whereby ambient air passing through the annular chamber is heated and fed to an associated one of one or more burners for improving combustion.

(b) Description of Prior Art

Various types of heat recuperators are known such as those described, for example, in Canadian Pat. Nos. 1,154,371, issued Sept. 27, 1983, and 1,163,911, issued Mar. 20, 1984. These types of heat recuperating devices are specifically for use with radiant tubes and are constructed directly within such tubes. The disadvantage of some recuperators is that they interfere with the flame of the tube, thus affecting the efficiency of the heat source and makes it difficult, if not impossible, to adjust the flame. Further, when adapting such radiant tube assemblies to existing furnaces, it is sometimes necessary to replace all of the radiant tubes with these new assemblies or to adapt them to the existing tubes. Such adaptation is very costly and time-consuming and it is also difficult to service these recuperators as the heat exchanger is incorporated within the radiant tube. Also, because the recuperator is in direct contact with the very hot flame, within the radiant tube, the heat exchange device will deteriorate more quickly. Also, because prior art recuperators are located inside or partly inside the radiant tubes, they in effect obstruct the exhaust. If gas accumulates in the tube, prior to combustion, an explosion will take place in the tube and because these devices obstruct the tube, there will be no direct exhaust and the recuperator will be severely damaged and could cause bodily injury.

SUMMARY OF INVENTION

It is a feature of the present invention to provide an improved heat recuperator which substantially overcomes all of the above-mentioned disadvantages of the prior art.

It is a further feature of the present invention to provide an improved heat recuperator which is secured outside the furnace wall and constructed as an exhaust tube which is connected to the outlet end of an associated radiant tube.

It is a further feature of the present invention to provide an improved heat recuperator which is provided as an exhaust tube and wherein ambient air is heated in an annular chamber provided in the exhaust tube with the inner wall of the chamber being corrugated whereby to induce turbulence to the ambient air and to provide a large heated surface area, as compared with a straight inner wall, whereby to enhance heat exchange between the heated exhaust gas at the outlet of the radiant tube and the ambient air.

Another feature of the present invention is to provide an improved heat recuperator which is located outside of the furnace wall and which is economical to construct and to service and does not require dismantling of the radiant tube for servicing.

According to the above features, from a broad aspect, the present invention provides a heat recuperator for use with a furnace having one or more gas combustion nozzle or pre-mix burners. The recuperator comprises an exhaust tube connectable to a furnace combustion chamber for receiving heated exhaust gas therethrough. The exhaust tube has an outer cylindrical wall and an inner metal tube concentrically supported therein. An annular space is defined between the outer cylindrical wall and the inner tube.

From another broad aspect, the inner tube is formed in at least a major length thereof with a plurality of corrugations. The corrugated wall induces turbulence to the ambient air and also provides a large heated surface area to enhance heat exhange between the heated exhaust gas and ambient air. Air inlet means is connected to an inlet end of the annular space downstream of the exhaust tube. Air outlet means is connected to the annular space upstream of the exhaust tube adjacent an inlet end and connectable to a burner to supply same with heated combustion air. Blower means is connectable to the inlet means to direct the flow of ambient air in the annular space from the inlet means to the outlet means of the annular chamber.

According to a still further broad aspect of the present invention, there is provided a method of recuperating heat loss from a furnace to enhance the efficiency of combustion of one or more nozzle or pre-mix burners of the furnace. The method comprises connecting one or more exhaust tubes to one or more furnace combustion chambers and wherein the exhaust tubes each has an annular chamber, and wherein hot combustion gas is exhausted in the inner metal tube. Ambient air is fed to a downstream inlet of the annular chamber of the one or more exhaust tubes and is displaced to an upstream outlet. The heated ambient air is then fed to a burner associated with respective ones of the one or more exhaust tubes and is mixed with a combustible gas to generate a flame.

According to a further aspect, the method comprises making the inner tube as a corrugated tube to subject the air to turbulence whereby to extract more heat from the corrugated wall.

BRIEF DESCRIPTION OF DRAWINGS

A preferred embodiment of the present invention will now be described with reference to an example thereof as illustrated by the accompanying drawings in which.

DESCRIPTION OF PREFERRED EMBODIMENTS

Figure 1:
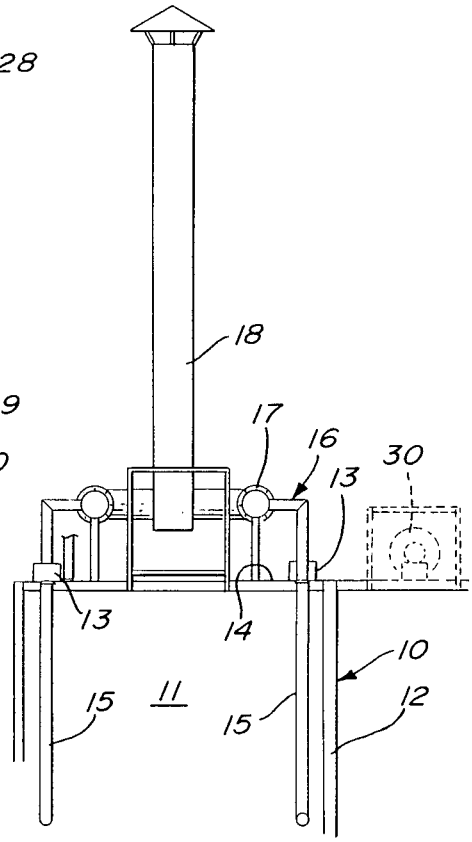
FIG. 1 is a fragmented view of a gas-burning furnace on which heat recuperators constructed in accordance with the present invention have been installed.

Referring now to the drawings, and more particularly to FIG. 1, there is shown a gas-fired furnace 10 having a hot chamber 11 delineated by a furnace wall 12. A plurality of nozzle or pre-mix burners 13, either gas or oil, are secured on the top wall 14 of the furnace in aligned relationship. For clarity of illustration, only two of these burners are shown. Each burner is connected to the inlet end of a respective radiant tube 15, which tube does not form part of the present invention and which is quite commonly known in the art as is, for example, illustrated with reference to Canadian Pat. No. 1,154,371. The radiant tube is of generally elongated U-shaped form and the burner 13 generates a flame into the radiant tube, which flame extends along a major length thereof and is visible from the outlet end of the tube.

The present invention is concerned with a heat recuperator 16 being connected to the outlet end of the radiant tube whereby to extract heat loss from the hot exhaust gas of these tubes. As herein shown, the outlets of the heat recuperators 16 are connected to a common exhaust manifold 17 which is connected to a chimney 18 to evacuate the furnace exhaust fumes.

Figure 3:
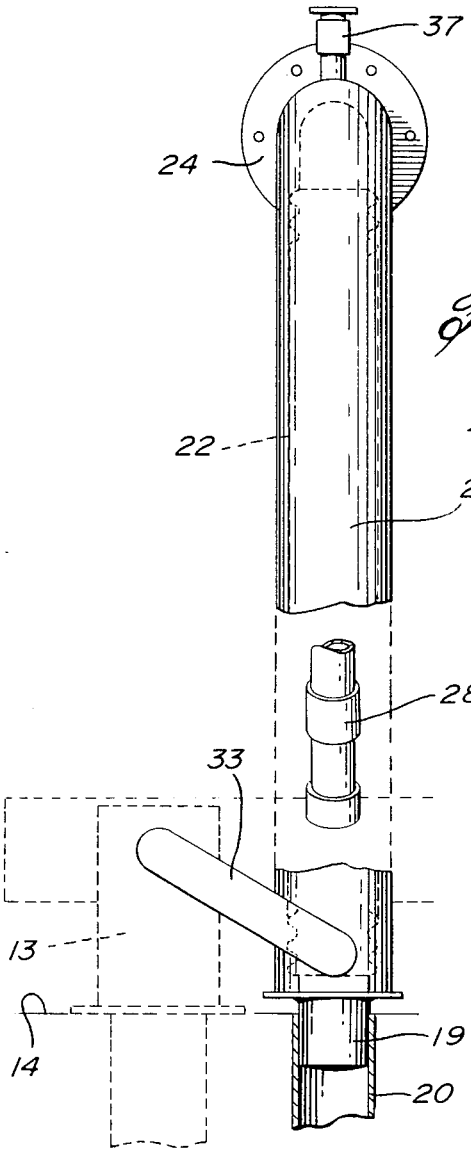
FIG. 3 is an end view of FIG. 2, partly fragmented, illustrating the heat recuperator of the present invention connected to a gas burner.
Figure 2:
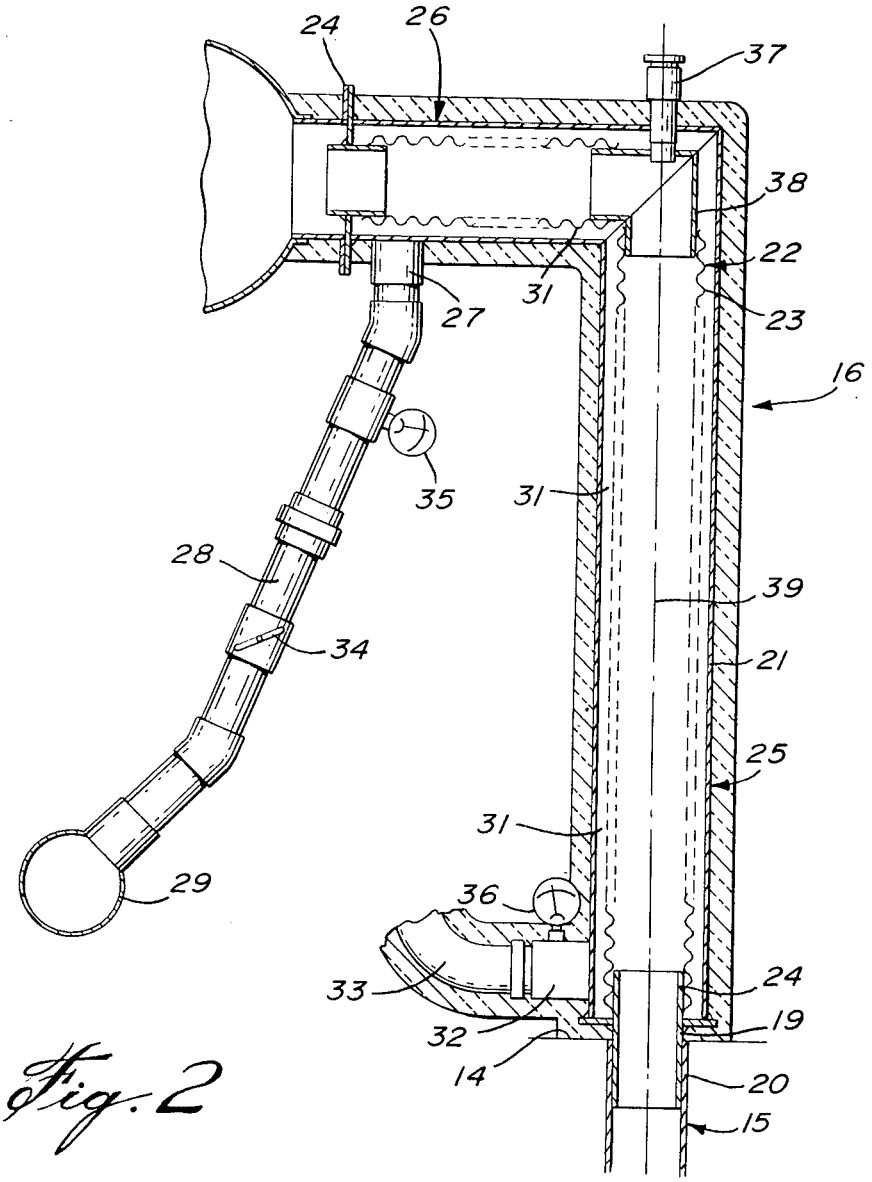
FIG. 2 is a side view, partly in section, of the heat recuperator of the present invention.

Referring now additionally to FIGS. 2 and 3, there is shown the detailed construction of the heat recuperator 16. The heat recuperator 16 is comprised as an exhaust tube having a lower connecting pipe 19 which is inserted directly in the outlet end 20 of an associated radiant tube 15. The exhaust tube 16 has an outer cylindrical metal wall 21 and an inner metal tube 22 formed in at least a major length thereof with a plurality of corrugations 23. The inner tube 22 is concentrically secured within the outer cylindrical metal wall 21 by end brackets 24 which in the lower end is constituted by a portion of the connected pipe 19 extending inwardly into the outer cylindrical wall 21. The hot exhaust gases from the radiant tube 15 are exhausted directly within the inner corrugated metal tube 22 to heat up the tube. The hottest part of the tube is, of course, that adjacent the upstream end 25 of the tube and gets cooler towards its downstream end 26.

The area between the outer cylindrical wall 21 and the inner corrugated tube 22 forms an annular space 31 into which ambient cooling air is directed for heating this air to feed a respective burner 13 whereby to provide preheated air to be mixed with a combustible gas to improve the burner efficiency. The ambient air is fed to an inlet connection 27 at the downstream end 26 of the exhaust tube 16 by means of a connecting conduit 28 which is connected to an intake manifold 29 to which a blower fan 30 is connected to feed air under pressure into the annular space 31 and cause circulation thereof from the inlet end 27 to the outlet end 32. An outlet conduit 33 connects the outlet end 32 to the burner 13.

By providing the inner tube 22 with a corrugated wall 23, the heat exchange capacity of the exhaust tube or recuperator is greatly enhanced. In this particular embodiment, the corrugated wall 23 of the inner tube 22 provides a surface area which is at least twice, herein three times, the surface area of a straight wall tube of the same length. Also, this corrugated wall 23 imparts turbulence to the ambient air as it is forced from the inlet end 27 to the outlet end 32 and imparts a spiral motion thereto whereby the air is in contact with a substantially large surface area provided by these corrugations and thereby results in enhanced heat exchange between the heated exhaust gas at the interior of the inner metal tube 22 and the ambient air.

The ambient or cool air conduit 28 is also provided with a control valve 34 to control the amount of cooling air admitted in the recuperator exhaust tube 16 dependent on the capacity of the burner 13. Also, in order to monitor the pressure at the inlet and outlet of the exhaust tube 16 there is provided an inlet pressure gauge 35 connected to the conduit 28 and an outlet pressure gauge 36 connected to the outlet 32. With the specific embodiment herein shown, the corrugated wall causes a pressure drop of about 4" in the exhaust tube 16 and this pressure drop is compensated by using a blower with appropriate capacity.

It is also pointed out that because of the reverse flow of the cooling air in the annular conduit 31, the cooling air encounters the hottest part of the inner metal tube 22 near its upstream end 25 at the point where it leaves the exhaust tube (its hottest area) and because the outlet conduit 33 is very short, heat loss at the outlet end of the exhaust tube is maintained at a minimum to provide for better burner efficiency.

The exhaust tube 16 herein shown is formed as an L-shaped tube having an elongated straight portion in its upstream end 25 and a short transverse section in its downstream end 26. The short transverse section provides more resistance to air flow as this section of the inner metal tube is the coolest thereby providing for better heat exchange. Also, this short transverse section makes it possible to install a sighting element 37 in the exhaust tube 16 extending to a corner bracket 38 and into the inside of the inner metal tube 22 in axial alignment with the longitudinal axis 39 of the elongated straight portion, whereby to view the flame within the radiant tube 15 for adjustment of the burner flame. This sighting element is provided with an optical lens resistant to the hot exhaust and is sealed to prevent any exhaust gas leaks therethrough. The construction of such element 37 is well known in the art.

As shown in FIG. 2, the entire recuperator 16 and its connections, may be covered with a ceramic fiber insulation 40 in order to prevent heat loss through the outer wall 21 and connection 32–33.

In summary, it can be seen that with the heat recuperator of the present invention, there is provided enhanced heat transfer between cooling air which is directed under pressure in an annular conduit 31 about a corrugated inner metal tube through which hot gases from a furnace are exhausted. Because the inner metal tube is corrugated the cooled air is exposed to a large hot surface area and is imparted a turbulence whereby to increase its trajectory from the inlet end 27 to the outlet end 32 whereby maximum heat transfer is achieved over a relatively short chamber. The recovered heated air is then fed directly into a burner where it is mixed with a combustible gas to improve the combustion efficiency. The hot exhaust gases leaving the combustion chamber heat the corrugated tube and the cycle is repeated.

It is within the ambit of the present invention to cover any obvious modifications of the example of the preferred embodiment described herein, provided such modifications fall within the scope of the appended claims. For example, the exhaust tube 16 may be provided as a straight exhaust tube or may have a different configuration. Still further, the heat recuperator may be connected directly to a combustion chamber being fed by an open-flame burner or burners and need not necessarily be associated with radiant tube type burners. However, the recuperator of the present invention was particularly developed for its use with a radiant tube burner and has proved very efficient in achieving fuel economy. Also, it is conceived that the recuperator be provided as a single stack chimney which may feed back hot combustion air to one or more nozzle or pre-mix burners.

Experiments were conducted with a heat recuperator constructed in accordance with the present invention and it was found that when connected to a radiant tube, having 3.3 times the surface area of a straight tube of the same length, and generating an exhaust temperature of about 1500° F., an 18% fuel saving was obtained. The preheated combustion air was raised to a temperature of 620° F. by the recuperator. The combustion air was fed to the inlet of the recuperator at about 70° F. and left the outlets of the recuperator at a temperature of about 620° F.

It is further possible to construct the inner tube 22 as a straight wall tube but the results in fuel savings would not be as good. However, some benefits would be obtained and there would still be no interference with the radiant tubes when used on such furnace. It is also conceived that the outside tube 21 can also be corrugated as well as the inside tube, causing still further turbulence.

I claim:

1. In a furnace having a hot chamber, a plurality of nozzle or pre-mix combustion burners in said hot chamber, radiant tubes connected to said combustion burners and extending into said hot chamber, an ambient air intake manifold and an exhaust manifold, heat recuperators for receiving exhaust gases from said hot chamber, each said recuperator comprising:

an uncorrugated cylindrical metal outer tube having the shape of an inverted L, a longer leg of said L extending vertically and terminating at a first end of said outer tube, said first end being secured to an extension of one of said radiant tubes, a shorter leg of said L extending horizontally and terminating at a second end of said tube, said second end being secured to said exhaust manifold;

an inverted L shaped uncorrugated metal corner tube in said outer tube at a joint between said longer and shorter legs, said corner tube having one end extending into said longer leg and another end extending into said shorter leg;

first and second imperforate inner metal tube members, said inner tube members each being formed as a corrugated tube having smoothly undulating corrugations defining both inner and outer walls thereof, said corrugations providing a direct heat transfer surface area at least twice that of a straight tube, said first inner tube member being connected between said radiant tube extension and said one end of said corner tube, said second inner tube member being connected between said exhaust manifold and said another end of said corner tube, said inner tube members and said corner tube together forming an inverted L shaped inner tube within said outer tube to discharge exhaust gas to said exhaust manifold, said inner tube being spaced from said outer tube to define an annular space between said inner and outer tubes, said annular space extending from said first end to said second end of said outer tube;

an outlet conduit connected between one of said combustion burners and a portion of said annular space adjacent said first end of said outer tube, said combustion burners being positioned adjacent said first end of said outer tube to minimize the length of said outlet conduit;

a connecting conduit connected between said intake manifold and a portion of said annular space adjacent said second end of said outer tube;

an air blower in said intake manifold for blowing ambient air through each said connecting conduit, said annular space and said outlet conduit to said combustion burners, whereby said corrugations induce turbulence in said ambient air and provide a large heated surface area to enhance heat exchange between said heated exhaust gas and ambient air;

insulation covering said outer tube and said outlet conduit;

a sighting tube aligned with said longer leg of said L shape of said outer tube, said sighting tube extending through said outer tube and said corner tube; and a control valve in said connecting conduit to control a quantity of air fed into said annular space.

* * * * *